US009500352B2

(12) United States Patent
Van Winkle

(10) Patent No.: US 9,500,352 B2
(45) Date of Patent: Nov. 22, 2016

(54) INTEGRAL LED LIGHT FIXTURE

(71) Applicant: ETi Solid State Lighting Inc., Vernon Hills, IL (US)

(72) Inventor: Gary Van Winkle, Chagrin Falls, OH (US)

(73) Assignee: ETi Solid State Lighting Inc., Vernon Hills, IL (US)

( * ) Notice: Subject to any disclaimer, the term of this patent is extended or adjusted under 35 U.S.C. 154(b) by 0 days.

(21) Appl. No.: 14/980,920

(22) Filed: Dec. 28, 2015

(65) Prior Publication Data

US 2016/0116146 A1 Apr. 28, 2016

Related U.S. Application Data

(63) Continuation of application No. 14/334,932, filed on Jul. 18, 2014.

(51) Int. Cl.

| | |
|---|---|
| ***F21V 23/00*** | (2015.01) |
| ***F21V 23/06*** | (2006.01) |
| ***F21V 3/04*** | (2006.01) |
| *F21V 23/04* | (2006.01) |
| *F21S 8/04* | (2006.01) |
| *F21V 3/02* | (2006.01) |
| *F21Y 101/00* | (2016.01) |

(52) U.S. Cl.

CPC ..... *F21V 23/009* (2013.01); *F21K 9/23* (2016.08); *F21K 9/232* (2016.08); *F21V 3/0445* (2013.01); *F21V 23/006* (2013.01); *F21V 23/06* (2013.01); *F21S 8/04* (2013.01); *F21V 3/02* (2013.01); *F21V 23/04* (2013.01); *F21Y 2101/00* (2013.01)

(58) Field of Classification Search

CPC ..... F21V 3/02; F21V 2/02; F21V 23/006; F21S 8/04

USPC ..... 362/650

See application file for complete search history.

(56) References Cited

U.S. PATENT DOCUMENTS

| | | | | |
|---|---|---|---|---|
| 3,248,534 A | | 4/1966 | Cahill et al. | |
| 3,757,107 A | * | 9/1973 | Peasley | F21S 9/02 362/186 |
| 4,302,798 A | * | 11/1981 | Sit | F21S 8/04 362/147 |
| 4,807,099 A | | 2/1989 | Zelin | |
| 5,034,869 A | * | 7/1991 | Choi | F21V 21/02 248/343 |
| 5,575,459 A | * | 11/1996 | Anderson | H05B 33/0809 313/318.03 |
| 5,626,415 A | * | 5/1997 | Huang | F21V 3/00 362/267 |
| 5,929,788 A | | 7/1999 | Vukosic | |

(Continued)

FOREIGN PATENT DOCUMENTS

CN 201547604 U 8/2010

*Primary Examiner* — Renee Chavez
*Assistant Examiner* — Christopher E Dunay
(74) *Attorney, Agent, or Firm* — Walter Haverfield LLP; D. Peter Hochberg; Sean F. Mellino

(57) ABSTRACT

An integral LED light fixture for installation in an incandescent light bulb socket includes a housing with a forwardly-extending portion and peripheral outer walls defining a recess, a rearwardly-extending socket base to be screwed into an incandescent light bulb socket, electrical components including a printed circuit board having a set of LEDs, and a lens for covering the printed circuit board and being attached to the housing. The integral LED light fixture cover can also be installed in a junction box. An AC version is also provided which lacks the driver component and the driver cover.

31 Claims, 6 Drawing Sheets

(56) References Cited

U.S. PATENT DOCUMENTS 6,454,437 B1 * 9/2002 Kelly ..... G01J 3/10 359/287
D540,957 S 4/2007 Mama
7,658,510 B2 2/2010 Russell
7,703,934 B2 4/2010 Pape et al.
7,712,925 B2 5/2010 Russell
8,672,496 B2 3/2014 O'Kane
8,967,831 B2 * 3/2015 Chien ..... F21V 3/02 362/234
2005/0243550 A1 11/2005 Stekelenburg
2005/0281031 A1 * 12/2005 Fu ..... F21S 9/037 362/253
2006/0145632 A1 * 7/2006 Fiene ..... H01R 31/065 315/291
2006/0146527 A1 7/2006 VanderSchuit
2006/0164864 A1 * 7/2006 Arihara ..... G02B 6/0016 362/621
2006/0164865 A1 * 7/2006 Bycroft ..... F21V 19/008 362/645
2011/0170294 A1 * 7/2011 Mier-Langner ..... F21S 8/02 362/294
2011/0309735 A1 * 12/2011 Parker ..... F21K 9/135 313/46
2012/0236569 A1 * 9/2012 Chang ..... F21V 3/02 362/294
2012/0313551 A1 * 12/2012 Nakajima ..... F21K 9/30 315/309
2013/0322079 A1 * 12/2013 Guercio ..... F21V 29/004 362/249.01
2014/0056026 A1 2/2014 Boomgaarden et al.
2014/0153255 A1 * 6/2014 Kimiya ..... F21S 8/04 362/311.02
2014/0204594 A1 * 7/2014 Kanazawa ..... F21K 9/30 362/362
2014/0293585 A1 * 10/2014 Hui ..... F21S 8/03 362/101
2015/0192254 A1 * 7/2015 Moon ..... F21K 9/1355 362/650

* cited by examiner

INTEGRAL LED LIGHT FIXTURE

CROSS-REFERENCE TO RELATED APPLICATION

This application is a continuation of U.S. patent application Ser. No. 14/334,932 filed Jul. 18, 2014, which is incorporated herein by reference in its entirety.

BACKGROUND OF THE INVENTION

Field of the Invention

This invention relates to illuminating devices and, in particular, to LED light fixtures which can be connected to incandescent sockets. The field of the invention further relates to dual-mount LED light fixtures which can be mounted to an incandescent socket on a ceiling or to a junction box mounted in a ceiling.

Description of the Prior Art

Light-emitting diodes or LEDs have become widely in use. They use much less power than do incandescent bulbs, yield a brighter light and are much less expensive than are incandescent bulbs. LEDs have become prevalent in the marketplace. LEDs last about 25 times longer than incandescent bulbs and are far less expensive to use than incandescent bulbs. According to a 2012 study made by the U.S. Department of Energy, for 50,000 hours of use one would require 42 incandescent bulbs as compared to one LED bulb. Likewise, the total cost of using an incandescent bulb for 50,000 hours was $352.50, as opposed to $85.75 for an LED. With respect to light output per bulb, an incandescent bulb yields from 300 to 900 lumens, as opposed to LED bulbs which emit 1,000 to 1,300 lumens. An incandescent bulb can use 60 watts per bulb, as compared to ten watts per bulb for an LED bulb.

There are, of course, some shortcomings of LED bulbs. For one, the fixture in which one or more LED bulbs are incorporated tend to be rather large and cumbersome, in part due to the requirement that many LED light fixtures must have a heat spread and a heat sink, since the temperature resulting from the usage of LED bulbs is significant. Furthermore, incandescent bulbs are used in incandescent receptacles, or Edison receptacles, which are in wide use. There are few if any fixtures incorporating LED bulbs which can be used with incandescent receptacles. Also, since most LED bulbs are operated using direct current circuits, there is therefore a requirement for an electronic device for converting alternating electric current to direct electric current.

There are a number of light fixtures for use with bulbs which are not ordinarily used in incandescent sockets. Chinese Application No. 200920235560.X (Utility Model No. CN 201547604 U) discloses an LED ceiling light that can be screwed into an incandescent light holder. A driver circuit is positioned below an Edison-base socket.

U.S. Pat. No. 5,929,788 (Vukosic, 1999) discloses a warning beacon including clusters of LEDs mounted on a circuit board which emit light into a conical reflector. It has a threaded pipe for installation on a post or stanchion. Different types of LED luminaires are disclosed in U.S. Pat. No. 7,658,510 (Russell, 2010) which have a screw-base interface which can be used in existing incandescent fixtures. The devices discussed in Russell '510 are quite bulky, in part because of the presence of heat sinks and other components of the system. The same LED fixture is disclosed in U.S. Pat. No. 7,712,925 (Russell, 2010) and is the parent of the foregoing '510 patent and discloses a similar device. Another LED lighting device is disclosed in U.S. Pub. No. 2006/0146527 (VanderSchuit, 2006) which incorporates a receptacle for receiving an incandescent bulb and has an additional array of LEDs for supplying an additional light source. A design for an LED bulb is shown in US D540,957 (Mama, 2007) which shows a socket for use with an incandescent receptacle and apparently incorporating an LED light source.

A low profile luminaire for being carried by a light fixture is disclosed in U.S. Pub. No. 2014/0056026 (Boomgaarden et al., 2014) which incorporates LEDs in a luminaire which also includes a reflector, a light guide and a heat sink. The device is rather complicated and includes a reflector disposed between a light source and a light guide, and incorporates a socket or Edison connector portion for use with an internally-threaded supply socket.

There are other known LED devices which incorporate screw-in light fixtures having components for incandescent receptacles. In U.S. Pat. No. 7,703,934 (Pape et al, 2010), a power outage socket device is disclosed having a male connector for insertion into a light socket of a lamp in place of a light bulb. A female socket for receiving the light bulbs is provided on the other side of the device. Additional light sources, such as LEDs, are provided which receive power from batteries incorporated in the device and which provide light in case the normal power supply is interrupted. U.S. Pat. No. 8,672,496 (O'Kane, 2014) discloses a novelty lighting device which is suspended from an incandescent bulb socket and has an internally motorized rotating mirror ball. The mirror ball is mounted to a ceiling 120 volt light circuit. It has a power supply for operating a series of LED lighting elements which are directed to the mirrored surfaces on the ball. An Edison base is mounted on a tubular member for insertion in a receptacle. The foregoing mirror ball is clearly very bulky.

Another device of some interest is U.S. Pat. No. 4,807,099 (Zelin, 1989) which includes a fluorescent light fixture having a connector stem for insertion in an incandescent lamp socket. A reflector is mounted between two twin-tube fluorescent lamps for use in reflecting light when the lamps are turned on.

There are no known low profile LED light fixtures or luminaires which are of relatively simple construction and which have dual-mounting capabilities in that they can be inserted alternatively in an incandescent bulb socket or attached to a junction box, and which have components which are disposed one within the other to render the light fixture very compact and have a small profile. Furthermore, there are no known devices of the foregoing type which are of light weight, give out adequate illumination yet are extremely easy to install either in an incandescent socket or a junction box.

SUMMARY OF THE INVENTION

An object of the present invention is the provision of an LED luminaire or LED light fixture (the term LED luminaire and LED light fixture will be used interchangeably and sometimes together herein) which can easily be mounted in an incandescent bulb receptacle.

Another object of the present invention is to provide an LED light fixture that can both be screwed into an incandescent socket or receptacle as well as into a junction box.

Another object of the present invention is the provision of an LED light fixture which can quickly be screwed into most existing porcelain and plastic lamp holders without requiring any additional wiring.

It is a further object of the present invention to provide a ceiling LED light fixture which is compact and thus has a small profile and extends relatively close to the ceiling socket or junction box to which it is connected.

A still additional object of the present invention is to provide an improved LED light fixture which provides uniform and diverse lumination without requiring a reflector.

It is yet another object of the invention to provide a compact LED light fixture which avoids pixilation to render the LED bulbs not discernable when the light fixture is turned on.

Also an object of the invention is to provide an LED luminaire or LED light fixture having a screw shell that is received into the body of the luminaire and works with a surface-mounted utility fixture.

A still further object of the present invention is to provide an LED light fixture having at least one model which complies with Section 4 of the Americans with Disabilities Act which provides as follows: "Objects projecting from walls with their leading edges between 27" and 80" above the finished floor shall protrude no more than 4" into walkways, corridors, passageways or aisles."

The provision of an attractive and non-obtrusive integral LED light fixture or luminaire is also an object of the present invention.

The provision of a light source which provides bright, pleasant illumination using lower electrical power and having a considerably longer life than corresponding incandescent illumination is a general object of the invention.

It is also an added object of the present invention to provide an LED luminaire which does not employ a separate component as a heat spreader.

The provision of an LED luminaire having an easy-to-remove lens from a base is also an object of the present invention.

It is a still further object to provide an integral LED luminaire with a screw-shell socket, having an outer rim that is flush or nearly flush with the surface to which it is mounted to provide mechanical support to resist dislodgment or breakage even if it is bumped from various angles.

An object of the invention related to the immediately-above object is the provision of an LED light fixture having a base with a twist-off lens to provide easy access to the interior of the light fixture.

A still further object of the invention is the provision of an integral LED light fixture having an interior construction to allow the LED walls to be closer to supporting surfaces to which the LED luminaire is mounted.

It is also an object to provide a light fixture which protects against light source breakage.

Another object is the provision of an integral LED light fixture which can be used in closets or other close spaces without concern of damage from heat or fire.

A general object of the present invention is the provision of an LED light fixture which is easy to use, and economical and efficient to manufacture.

These and other objects should be apparent to those skilled in the art from the description herein and from the appended claims.

The foregoing objects are achieved by the preferred embodiment of the invention which basically an integral LED light fixture which comprises a housing base having extended in the rearward direction a socket base having a screw-in portion for being screwed into an incandescent light socket for making electrical connection for energizing LED bulbs. The incandescent light socket can be in a ceiling, on a wall, in a lamp fixture, in a floor fixture or elsewhere. The LED light fixture has a lamp base having a cylindrical peripheral wall with a flared-out rim and a forwardly-extending larger cylindrical central portion with a forwardly-extending smaller central portion forming a socket mounting base. (As used herein, "forward" or "forwardly" means extending downwardly when the LED light fixture is connected to an incandescent receptacle mounted in a ceiling, and "rearward" or "rearwardly" means closer to the ceiling.) The larger cylindrical central portion has a forward annular face. The exterior of the rim has a screw thread or a bayonet-type fitting. The cylindrical central portion has a frusto-conical wall opposite the cylindrical peripheral wall to define an annular recess. A slot runs through the two central portions for receiving electrical wires as discussed below. The larger cylindrical central portion has fastener-receiving holes, to be explained later.

A series of electrical components are provided for generating LED illumination. For DC LED diodes or bulbs, these include a driver for converting a higher incoming voltage to a lower voltage for the LED printed circuit board discussed below which is configured as a segment and dimensioned to fit in the annular recess, which effectively decreases the depth of the LED fixture had the driver been mounted on the forward face of the cylindrical central portion. A driver cover, also called a ballast or brick, also in the shape of a segment, fits over the driver, and it, too, is received in the annular recess to further decrease the depth of the light fixture when it is mounted on the cylindrical central portion. A flat printed circuit board having a portion of the electrical circuitry embedded therein and having an array of LEDs is provided. The printed circuit board has a circular periphery, is dimensioned to engage the cylindrical peripheral wall, has a circular orifice for receiving the smaller cylindrical portion and is seated on the forward annular face of the larger cylindrical central portion. This arrangement is, in effect, a telescoping or nesting assembly which decreases the depth or height of the interior components of the LED light fixture beneath what it would have been had the components been stacked one upon the other without the telescoping or nesting arrangement. The printed circuit board has fastener-receiving holes matching the like holes in the larger cylindrical central portion for receiving fasteners which lock the printed circuit board in place in the LED light fixture assembly. Electrical wires are connected to the socket base, run through the slots in the larger and smaller central portions and are connected to the printed circuit board to form an electrical circuit.

The preferred embodiment of the invention has a lens with a generally partial egg-shaped configuration in the forward free portion and a flared-out slightly curved frusto-conical base portion. The base portion has an interior threaded recess for receiving the thread on the exterior of the rim of the lamp base so that the lens can be installed on or removed from the lamp base by a simple twist motion due to the bayonet fitting.

The LED light fixture summarized above can also be connected to a junction box. A mounting cap or plate is provided for being attached to the open end of the junction box, which box is normally mounted on a ceiling so the open end is normally facing downwardly. One set of fasteners would attach the luminaire to the mounting cap, and another set of fasteners would attach the mounting cap to the junction box. A transformer connects the external power supply to the LED light fixture.

One version of the LED light fixture according to the present invention is activated by a single on-off switch to the external power supply. A pull-chain activator can be an added feature to the LED light fixture.

DESCRIPTION OF THE PREFERRED EMBODIMENT

Figure 1:
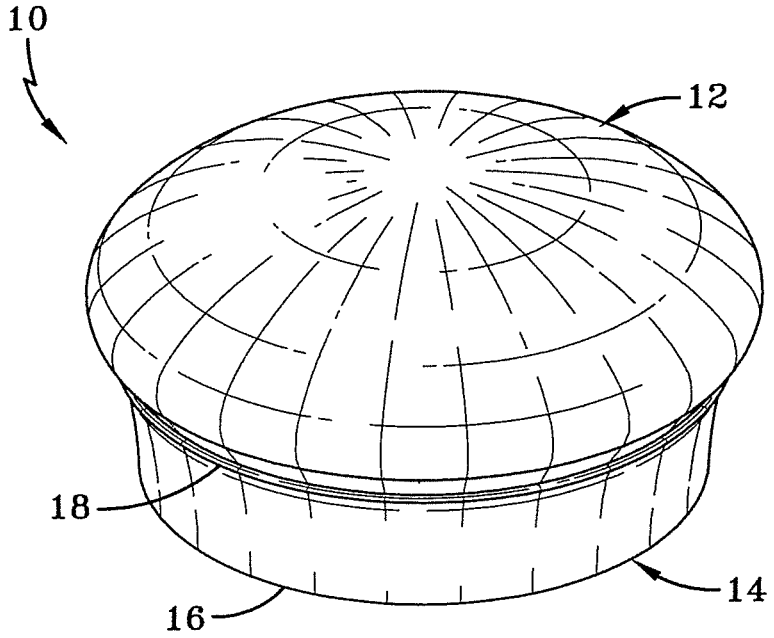
FIG. 1 is a perspective view of the LED luminaire or LED light fixture according to the preferred embodiment of the invention.
Figure 2:
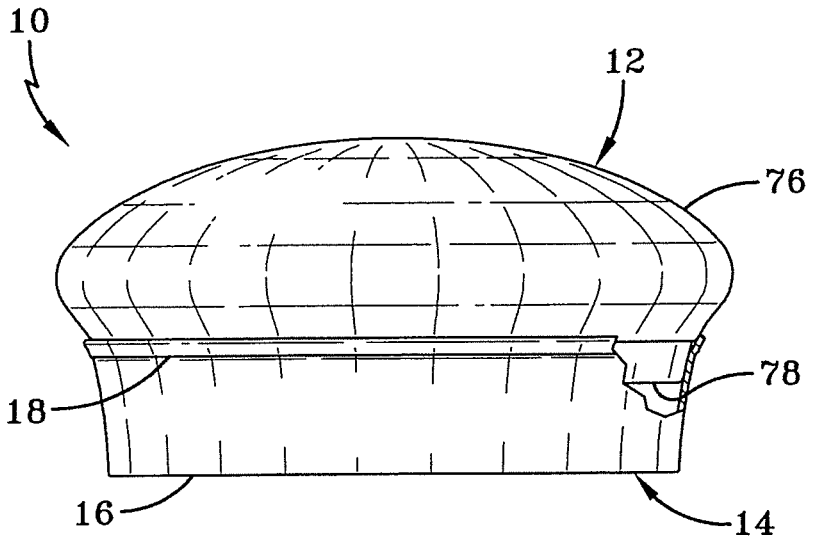
FIG. 2 is a side view of the LED light fixture shown in FIG. 1.
Figure 3:
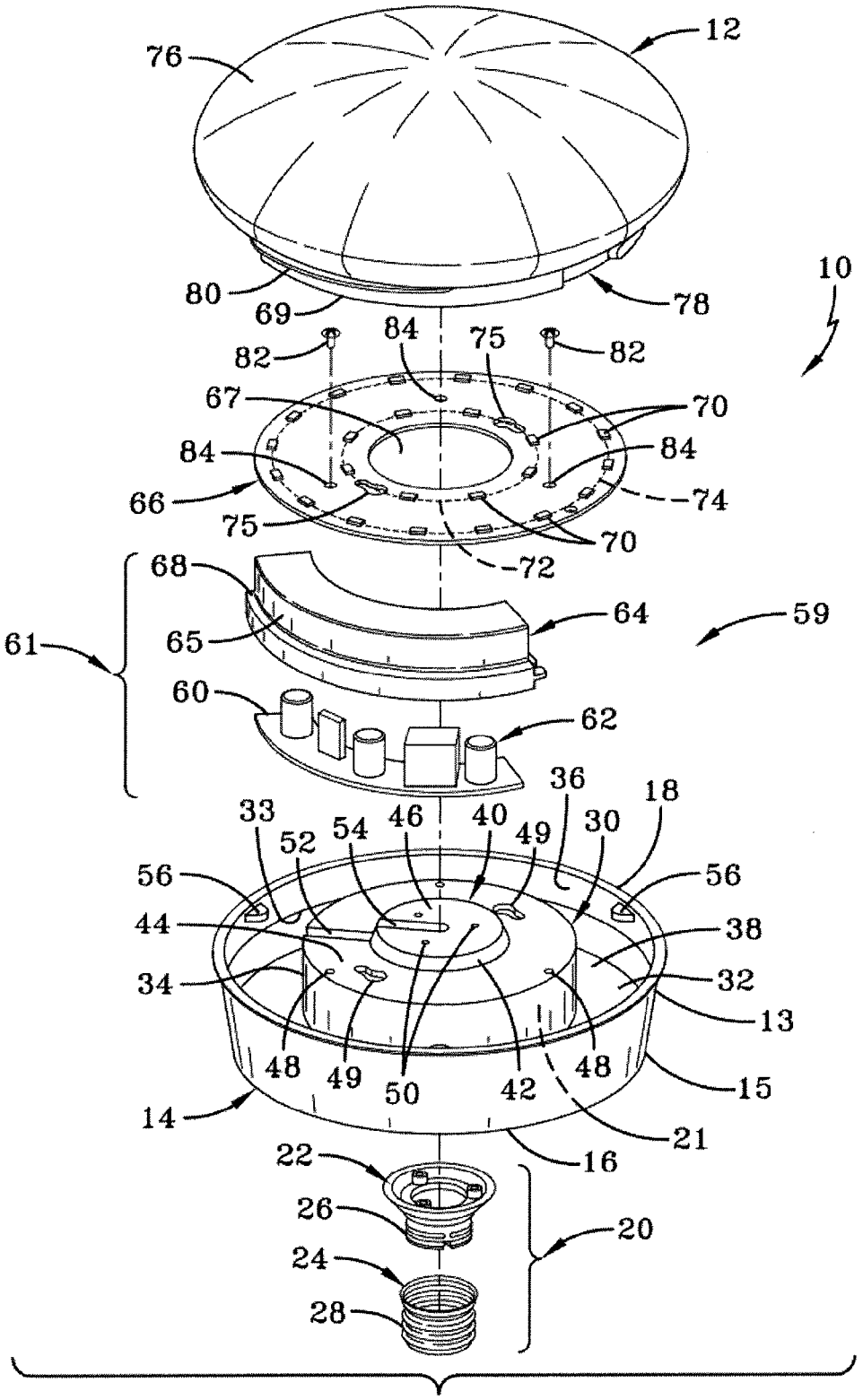
FIG. 3 is an exploded view of the LED light fixture shown in FIG. 1.

Referring first to FIGS. 1-3, an LED luminaire or LED light fixture 10 is shown. Light fixture 10 includes a lens 12 which is preferably a translucent plastic and a lamp or housing base 14 having a peripheral forwardly-extending outer wall 16 that is frusto-conical in configuration, flaring outwardly to an outwardly-flared, frusto-conical rim 18 having a greater amount of chamfer than does wall 16. Housing base 14 has a forward housing base portion 13 and a rearward housing base portion 15. LED light fixture 10 is defined as being "integral" because all of the components are self-contained; all one needs to do is simply screw the integral LED light fixture 10 into an incandescent light bulb socket.

FIG. 3 is an exploded view of LED luminaire or LED light fixture 10 showing lens 12 and lamp base 14 described above. A socket base 20 is provided in a rear portion 21 of lamp base 14, and it includes a junction body 22 which is permanently connected to an Edison lamp base or incandescent light bulb socket assembly 24 by means of a junction body stem 26 which is inserted into Edison lamp base 24. Lamp base 24 is preferably an E26 lamp base and has external threads 28 which can be screwed into an incandescent bulb socket. Socket base 20 is permanently fixed to the rear part of housing base 14.

Housing base 14 has a larger "cylindrical" forwardly-extending central portion 30 protruding from a support 32, and central portion 30 has a central wall which is preferably a frusto-conical wall 34 that is opposite to and parallel with a forwardly-extending interior wall 36, the latter being the interior of the peripheral outer wall 16. Defined on the underside of central portion 30, and the entire space within outer wall 61 on the underside of LED light fixture 10, is rear portion 21. An LED light fixture 10 is shown in FIG. 3. Forwardly-extending interior wall 36 extends from an outer edge portion 33. Frusto-conical wall 34 and interior wall 36 form an annular housing base recess 38. Protruding from the central part of central portion 30 is a smaller "cylindrical" central portion 40 of which central portion 30 is comprised, having frusto-conical walls 42. The forward part of central portion 30 is a flat, annular face 44, and the forward part of smaller "cylindrical" central portion 40 has a flat, generally-circular face 46.

A pair of holes 49 in the shape of church-key holes are provided in face 44 for a reason explained later. A set of fastener holes 50 are provided in face 44, and similar fastener holes 48 are provided in face 46. A wire-holding slot 52 extends in central portion 30, and a correspondingly-aligned wire-holding slot 54 extends in smaller "cylindrical" central portion 40. A set of interior extending tabs 56 are on the inside of rim 18.

Figure 5:
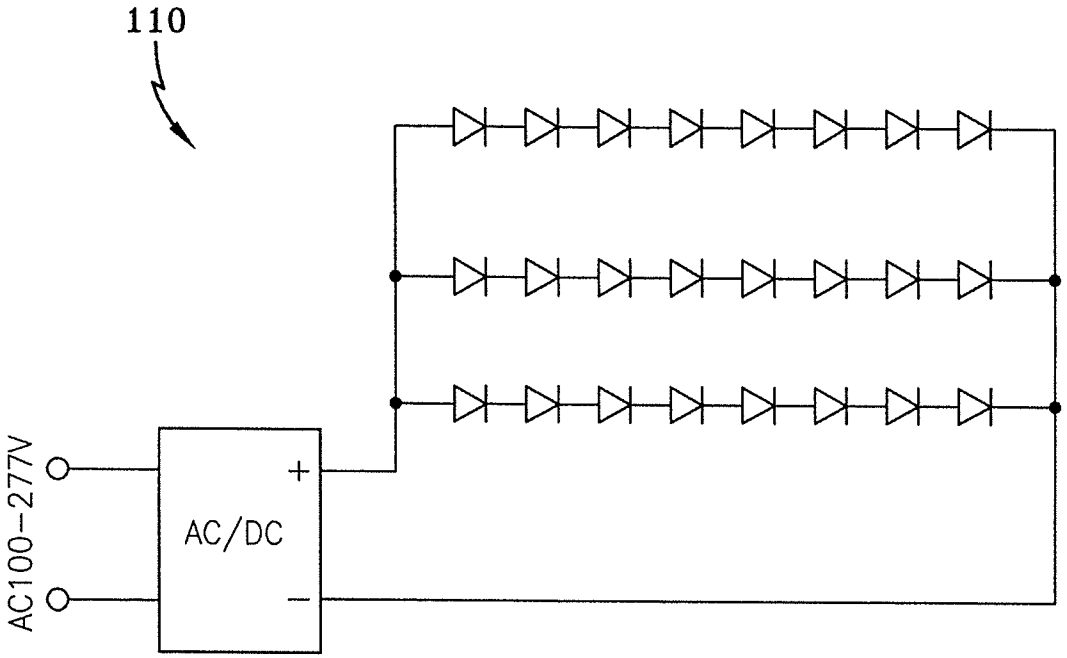
FIG. 5 is a circuit diagram for an AD/DC transformer assembly.

LED light fixture 10 incorporates electrical components 59, which in turn include a printed circuit board or light engine 66 and electrical conversion components 62 for converting incoming voltage to subsequently usable voltage and alternating current (AC) to direct current (DC) for enabling the illumination of LED light bulbs or LED diodes 70 as discussed below. Electrical conversion components 61 for the United States include a driver component 58 and driver cover 64. Driver component 58 is provided for converting 120 V to 3 V (under the U.S. electrical system). Driver component 58 has a segmented driver base 60 which is designed to fit into annular housing base recess 38 to reduce the height or depth of LED light fixture 10. Electrical conversion components 62 are preferably electrical components that extend forwardly from the segmented driver base 60. An electric circuit diagram for driver component 58 is shown in FIG. 5, showing electric devices generally with the numeral 110.

Driver cover 64 has a driver cover body 65 configured to match and cooperate with segmented shape of base 60 of driver component 58. Driver cover 64 has a 12 V input and is electrically connected to both driver component 58 and to printed circuit board 66. Driver cover 64 also fits into annular housing base recess 38, further reducing the height or depth of LED light fixture 10. Driver cover 64 houses driver cover electrical components 65 for reducing the depth of LED light fixture 10. Driver cover 64 has an annular shoulder 68 for a rearward base edge 69 of lens 12 to sit on.

Figure 6:
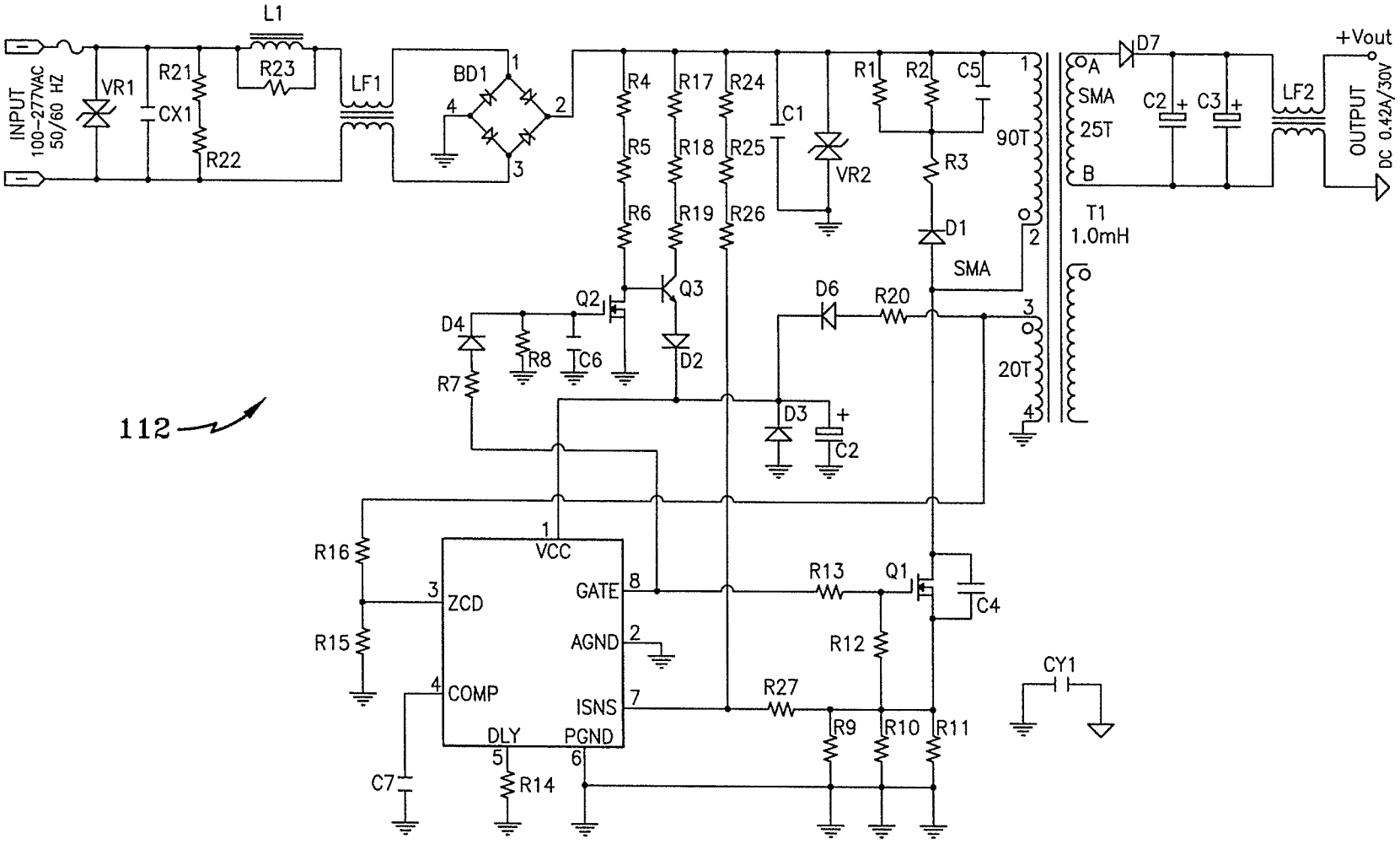
FIG. 6 is a circuit diagram for a driver component and a printed circuit board having the LEDs.

Printed circuit board 66 has a copper base and an array of LED light bulbs 70 soldered evenly in place. There is an imaginary inner ring 72 of equidistantly located LED light bulbs 70 and an imaginary outer ring 74 of equidistantly located LED light bulbs 70. The pair of wires (not shown) which are electrically connected to socket base 20 and extend into slots 52 and 54, and which transmit electrical power to driver component 58 and driver cover 64, are soldered to printed circuit board 66 to supply electric power thereto. Printed circuit board 66 is an annular disc having an orifice 67 therein of a diameter to fit over smaller "cylindrical" central portion 40 in a telescoping fashion whereby printed circuit board 66 does not increase the depth of the components connecting lamp base 14, driver component 58 and driver cover 64. A pair of holes 75 in the shape of church-key holes are identical to holes 49 in central portion 30. The function of holes 49 are discussed below. An electric circuit for driver cover 64 and printed circuit board 66 is shown in FIG. 6, with electrical devices shown generally as number 112. The resistance in the resistors are the same.

Lens 12 has a generally elliptoid configuration with an elliptoid light dispersing portion 76 and a lens base 78 which is of generally cylindrical shape having a set of screw slots 80 extending there through to receive tabs 56. Slots 80 and tabs 56 enable lens 12 to be attached to housing base 14 by a simple twisting motion due to the bayonet connection between lens 12 and housing base 14.

Housing base 14 is advantageously made from brushed nickel. Lens 12 and housing base 14 have an attractive appearance and, due in part to the telescoping or nesting arrangement of driver component 58 and driver cover 64 and failure of printed circuit board 66 to increase the depth of lamp base 14, can sit very close to a ceiling in which LED light fixture 12 is located since lens 12 is not required to have a large volume. Lens 12 is preferably made from the translucent plastic PMMA. Lens 12 disperses light emitted by LED light bulbs 70 equally and is shaped to avoid pixilation.

Figure 7:
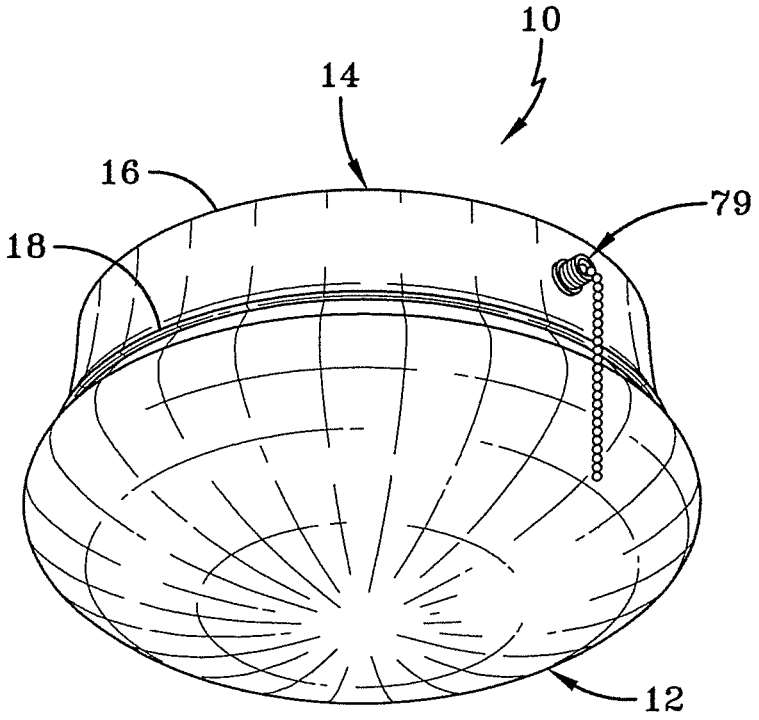
FIG. 7 is an LED light fixture according to a preferred embodiment with an on-off light switch.

Lens 12 can have a depth or height of 3.62" and meet the requirement of the Americans with Disabilities Act discussed above. An embodiment has also been developed having a pull chain on-and-off switch. This is shown in FIG. 7, where pull chain on-and-off switch 79 is used to turn LED light fixture 10 on and off.

Figure 4:
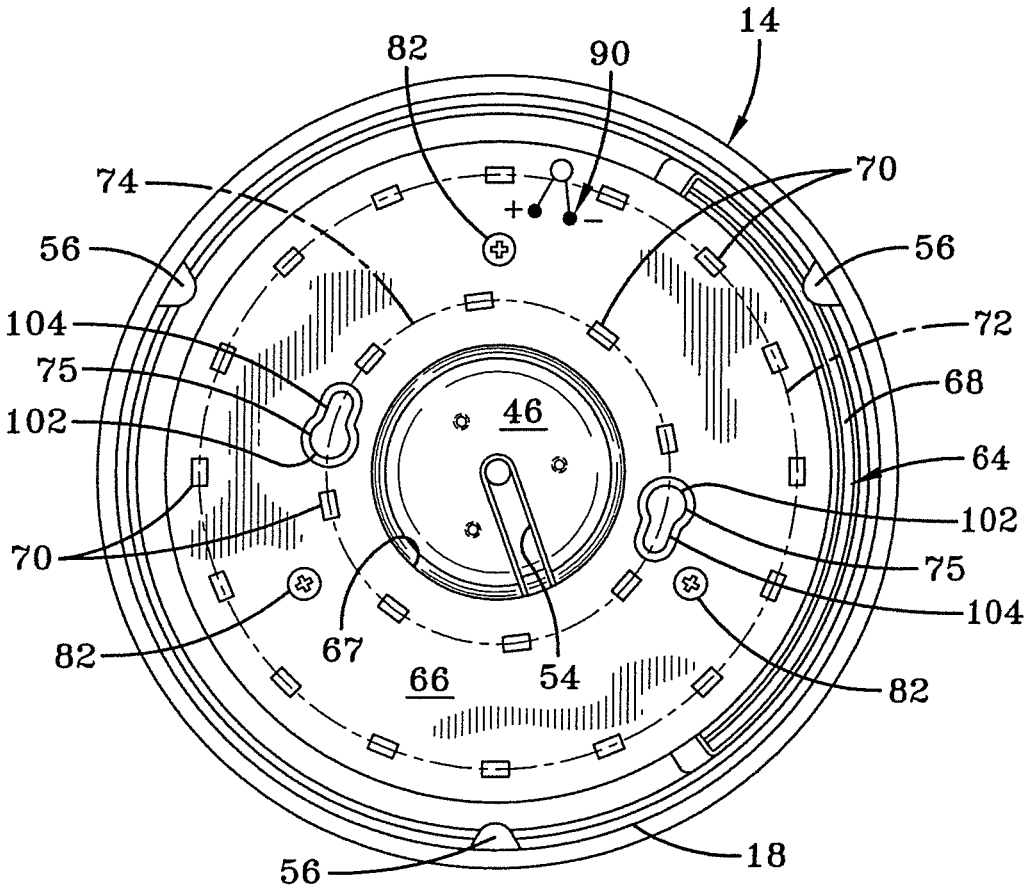
FIG. 4 is a plan view of the LED light fixture shown in FIG. 1 without the lens.

FIG. 4 shows the preferred embodiment of the invention without lens 12. The outer portion of housing base 14 is shown with rim 18 and tabs 56 in view. Printed circuit board 66 is shown having 24 LED light bulbs 70 attached thereto with 8 LED light bulbs 70 on imaginary circle 72 and 16 LED light bulbs 70 on imaginary circle 74. Smaller "cylindrical" central portion 40 protrudes through orifice 67. Holes 75 are shown, and a pair of solder points 90 are shown where the wires (not shown) are soldered to printed circuit board 66. Shoulder 68 of driver cover 64 is also visible. Slot 54 and fastener holes 50 can be seen in FIG. 3. Printed circuit board 66 is fixed to central portion 30 by a set of three screws 82, and screws 82 are shown installed in a set of retainer holes 84 in printed circuit board 66 and in holes 48 in central portion 30 visible in FIG. 3. A set of longer screws are provided for extending through the larger part of holes 75 in printed circuit board 66 with the larger part of aligned holes 49 in central portion 30.

Figure 8:
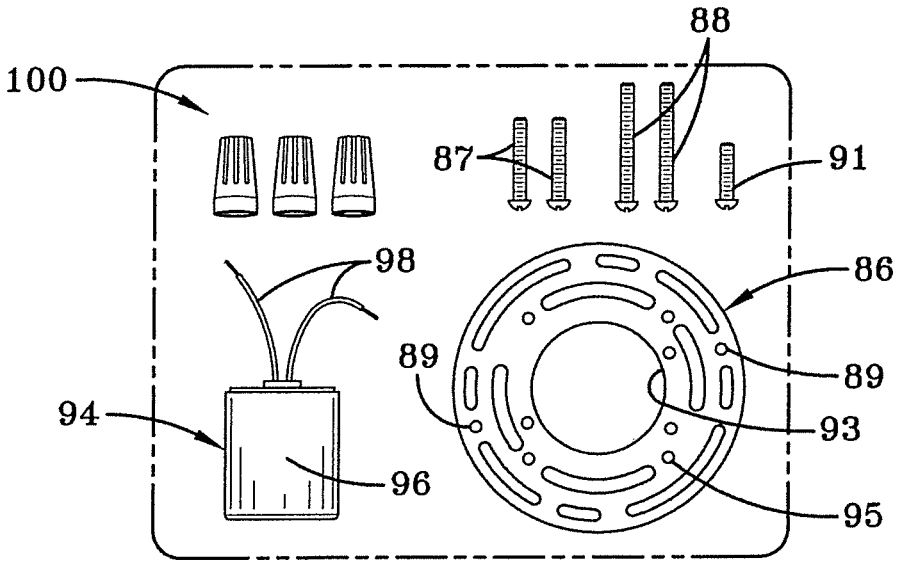
FIG. 8 shows components for mounting the LED light fixture shown in FIG. 1 to a junction box.

LED light fixture 10 can also be installed in a junction box. Referring to FIG. 8, a mounting cap or plate 86 is shown for the direct mounting of LED light fixture 10 to an outlet, ceiling or junction box. First, the electric power to the junction box is turned off. A first set of screws 88 is provided for extending through screw holes 89 in cap 86 to attach cap 86 to the junction box. Another screw 91 is provided for securing ground wires from the junction box, and this is done by running the ground wires through a center hole 93 and running screw 91 through the looped ground wires into a screw hole 95. Wires 98, with appropriately colored (such as black and white) coverings which are part of an incandescent bulb socket assembly 94, are wrapped around similarly colored conducting wires running through hole 93 and secured with wire nuts 100. An incandescent bulb socket 96 also is located in or below hole 93. Socket base 20 is then screwed into bulb socket 96. Housing base assembly 14 is then positioned with church-key shaped holes 75 in alignment with screws 89, and housing base assembly 14 is then moved towards cap 86 so that the head of screws 89 extends through an enlarged portion 102 of holes 75. Housing base assembly 14 is then twisted counterclockwise so that screws 81 slide along a narrow portion 104 of holes 75 to secure housing base assembly 14 in place. Lens 12 is then twisted inside the rim 18 to render LED light fixture 10 ready for use. The power is then turned on and illumination occurs.

A variation of the foregoing LED light fixture involves using AC LED diodes or AC LED bulbs instead of DC LED diodes or bulbs and would make driver component 58 and driver cover 64 unnecessary. In this case, orifice 67 of printed circuit board 66 would receive central portion 40 to reduce the height or depth of the internal components of LED light fixture 10. Printed circuit board 66 and housing base 14 would nest together to reduce their height from what it would have been had the two been stacked one on top of the other without nesting.

The preferred embodiment of the invention achieves each of the objects set for the above. LED light fixture 10 can be installed with no wiring required by the user. LED light fixture 10 can be installed in either an incandescent light socket or a junction box. When installed in a light socket, one simply inserts socket base 20 in the socket and turns light fixture. The rearward edge of housing base 14 is relatively close to the ceiling or other support for the socket or fixture in which the socket is located if the fixture is broad enough. Lens 12 and housing base 14 are impact resistant. LED light fixture 10 provides a clean light output, The invention has been described in detail with particular emphasis on the preferred embodiment thereof, but variations and modifications may occur to those skilled in the art to which the invention pertains from the foregoing discussion and the appended claims.

The invention claimed is:

1. An integral LED light fixture for being mounted to a ceiling, said light fixture having a forward portion distal a ceiling when said light fixture is mounted to the ceiling and rearward portion proximal a ceiling when said light fixture is mounted on the ceiling, said LED light fixture comprising:

a housing base having a forward housing base portion and a rearward housing base portion, said housing base including a forwardly-extending outer wall and a forwardly-extending central portion, said forwardly-extending outer wall and said forwardly-extending central portion defining therebetween an annular housing base recess in said housing base, and a rear portion including the underside of said forwardly-extending central portion;

a socket base located in said rear portion and being operatively connected to said rearward housing base portion of said housing base for making electrical connection with an incandescent light socket, and for receiving electrical current from the incandescent light socket; and a series of electrical components operatively connected to said housing base for generating LED illumination, said series of electrical components including:

a printed circuit board comprising a set of LEDs, and electrical circuitry for transmitting electricity to actuate said set of LEDs; and driver components electrically connected to said socket base for converting the electrical current received from said socket base to electrical current having the necessary characteristics for actuating said LEDs, said driver components and said printed circuit board having respective rearward-to-forward heights, said height of said rearward-to-forward driver components and said rearward-to-forward height of said printed circuit board cumulatively having a total cumulative height;

said printed circuit board and said driver components being nested together to form a total nested height; said total nested height being less than said total cumulative height, and said socket base, said housing base, said printed circuit board and said driver components being fixedly attached to each other;

a socket base located within the rear portion without extending rearwardly beyond said forwardly-extending outer wall for making electrical connection with an incandescent light socket, and for transmitting electrical current with an incoming voltage from the incandescent light socket, said socket base including an Edison lamp base for being screwed into an incandescent bulb socket; and a lens removably attached to said housing base and enclosing said series of electrical components.

2. An integral LED light fixture according to claim 1 wherein said housing base has an external housing height and said lens having a lens height, said lens height being no greater than twice said external housing height.

3. An integral LED light fixture according to claim 1 wherein said driver components are electrically connectable to said socket base and being receivable in said annular housing base recess, said driver components providing current to said set of LEDs to illuminate said LEDs.

4. An integral LED light fixture according to claim 3 and further comprising a driver cover for housing said driver components and being connectable to said socket base and to said driver components, said driver cover being receivable in said annular housing base recess.

5. An integral LED light fixture according to claim 4 wherein said driver components and said driver cover are nested together in said annular housing base recess to reduce the cumulative height of said driver components and said driver cover from what said cumulative height would had been had said driver cover been stacked on said driver components without being nested.

6. An integral LED light fixture according to claim 3 wherein said driver components are configured to fit entirely within said annular housing base recess.

7. An integral LED light fixture according to claim 6 and further comprising a driver components base annular segment being shaped and shaped to fit inside said annular housing base recess.

8. An integral LED light fixture according to claim 6 and further comprising a driver cover for housing said driver components, said driver cover comprising a driver cover body, said driver cover being configured to fit in said annular housing base recess.

9. An integral LED light fixture according to claim 8 wherein said driver cover comprises a driver cover body annular segment configured in shape and dimension to fit inside said annular housing base recess.

10. An integral LED light fixture according to claim 9 wherein said driver components and said driver cover body annular segment are configured to nest together within said annular housing base recess.

11. An integral LED light fixture according to claim 1 wherein said forwardly-extending central portion has a central part, and said forwardly-extending central portion comprises a small central portion protruding forwardly from said central part; and said printed circuit board comprises an orifice dimensioned and configured for enabling said small central portion to extend through said orifice to reduce the cumulative height of said housing and said printed circuit board compared to the cumulative height if said printed circuit board without said orifice were stacked on said forwardly-extending central portion.

12. An integral LED light fixture according to claim 11 wherein said small central portion has frusto-conical configuration tapering inwardly and forwardly from the remainder of said forwardly-extending central portion.

13. An integral LED light fixture according to claim 12 wherein said orifice of said printed circuit board is dimensioned and configured for enabling said small central portion to extend through said orifice but blocking said remainder of said forwardly-extending central portion from extending through said orifice.

14. An integral LED light fixture according to claim 1 wherein said integral LED light fixture is devoid of a reflector.

15. An integral LED light fixture according to claim 1 wherein said LED light fixture is devoid of a solid heat sink.

16. An integral LED light fixture according to claim 1 and further including junction box components for enabling said integral LED light fixture to alternatively be installed in a junction box, said junction box components comprising:

a mounting plate for being secured to a junction box, and said housing base and said series of electrical components being operatively connectable to said mounting plate;

an incandescent light bulb socket assembly operatively connectable to said socket base, said incandescent light bulb assembly being electrically connectable with said socket base; and electrical wires connectable to an external electric power source to effect the illumination of said set of LEDs.

17. An integral LED light fixture according to claim 1 wherein said lens is composed of translucent plastic PMMA and configured to eliminate LED pixilation.

18. An integral LED light fixture according to claim 1 and further including an on-off pull switch operatively connected to said electrical circuitry for selectively allowing or not allowing electrical current to be transmitted to said LEDs.

19. An integral LED light fixture according to claim 1 wherein:

said forwardly-extending outer wall comprises inwardly extending tabs; and said lens comprises screw slots for receiving said inwardly extending tabs to enable a twisting motion of said lens with respect to said forwardly-extending outer wall to provide a bayonet connection between said lens and said forwardly-extending outer wall.

20. An integral LED light fixture according to claim 1 wherein said rearward housing base portion has an outer rim for being flush with a support surface surrounding an incandescent light socket when said socket base makes electrical connection with said light socket.

21. An integral LED light fixture for being mounted to a ceiling, said light fixture having a forward portion distal a ceiling when said light fixture is mounted to the ceiling and a rearward portion proximal a ceiling when said light fixture is mounted on the ceiling, said LED light fixture comprising:

a housing base including:

a forward housing base portion;

a rear portion;

a non-electrically conducting, forwardly-extending outer wall defining a forwardly-extending interior wall; and a forwardly-extending central portion defining both an interior wall opposite said forwardly-extending interior wall to define an annular housing base recess on the forward side of said housing base and at least part of said rear portion on the underside of the forwardly-extending central portion;

a socket base located within the rear portion without extending rearwardly beyond said forwardly-extending outer wall for making electrical connection with an incandescent light socket, and for transmitting electrical current with an incoming voltage from the incandescent light socket, said socket base including an Edison lamp base for being screwed into an incandescent bulb socket; and a series of electrical components for generating LED illumination operatively connected to said housing base, said series of electrical components including:

a set of LEDs; and electrical circuitry for transmitting electricity to actuate said set of LEDs; and a lens removably attached to said housing base and enclosing said series of electrical components.

22. An integral LED light fixture according to claim 21 wherein said housing base has an external housing height and said lens has a lens height, said lens height being no greater than twice said external housing height.

23. An integral LED light fixture according to claim 21 and having a rearward housing base portion with an outer rim for being flush with a support surface surrounding an incandescent light socket when said socket base makes electrical connection with an incandescent light socket.

24. An integral LED light fixture for being mounted to a ceiling, said light fixture having a forward portion distal a ceiling when said light fixture is mounted to the ceiling and rearward portion proximal a ceiling when said light fixture is mounted on the ceiling, said LED light fixture comprising:

a housing base having a forward housing base portion and a rearward housing base portion, a forwardly-extending outer wall and a forwardly-extending central portion, said forwardly-extending central portion and said forwardly-extending outer wall defining an annular housing base recess in said housing base on the forward side of said housing base, and said forwardly-extending central portion further defining at least a part of a rear portion on the underside of said forwardly-extending central portion;

a socket base located within the rear portion without extending rearwardly beyond said forwardly-extending outer wall for making electrical connection with an incandescent light socket, and for transmitting electrical current with an incoming voltage from the incandescent light socket, said socket base including an Edison lamp base for being screwed into an incandescent bulb socket; and a printed circuit board comprising both a set of LEDs, and electrical circuitry for transmitting electricity to actuate said set of LEDs.

25. An integral LED light fixture according to claim 24 wherein:

said forwardly-extending outer wall comprises inwardly extending tabs; and said lens comprises screw slots for receiving said inwardly extending tabs to enable a twisting motion of said lens with respect to said forwardly-extending outer wall to provide a bayonet connection between said lens and said forwardly-extending outer wall.

26. An integral LED light fixture according to claim 24 wherein said rearward housing base portion comprises an outer rim for being flush with a support surface surrounding an incandescent light socket when said socket base makes electrical connection with the incandescent light socket.

27. An integral LED light fixture for being mounted to a ceiling, said light fixture having a forward portion distal a ceiling when said light fixture is mounted to the ceiling and rearward portion proximal a ceiling when said light fixture is mounted on the ceiling, said LED light fixture said integral LED light fixture comprising:

a housing base having a forward housing base portion and a rearward housing base portion, said housing base comprising a peripheral forwardly-extending outer wall including an outwardly flared frusto-conical forward rim, said outwardly flared frusto-conical forward rim having a greater amount of chamfer than does the remainder of said outer wall, said outer wall comprising a forwardly-extending interior wall, said housing base further comprising:

a forwardly-extending central portion opposite to said forwardly-extending interior wall and having a central wall;

wherein said central wall and said forwardly-extending interior wall form an annular housing base recess;

a rear portion; and a socket base located within the rear portion without extending rearwardly beyond said forwardly-extending outer wall for making electrical connection with an incandescent light socket, and for transmitting electrical current with an incoming voltage from the incandescent light socket, said socket base including an Edison lamp base for being screwed into an incandescent bulb socket; and electrical components for generating LED illumination operatively connected to said housing base, said electrical components comprising:

a printed circuit board comprising a set of LEDs, and electrical circuitry for transmitting electricity to actuate said set of LEDs to emit illumination, said printed circuit board being located on said forwardly-extending central portion;

said printed circuit board and said electrical circuitry being operatively connected together; and a lens removably attached to said housing base and enclosing said electrical components and said forwardly-extending central portion.

28. An integral LED light fixture according to claim 27 wherein:

said forwardly-extending outer wall comprises inwardly extending tabs; and said lens comprises screw slots for receiving said inwardly extending tabs to enable a twisting motion of said lens with respect to said forwardly-extending outer wall to provide a bayonet connection between said lens and said forwardly-extending outer wall.

29. An integral LED light fixture according to claim 26 wherein said rearward housing base portion has an outer rim for being flush with a support surface surrounding an incandescent light socket when said socket base makes electrical connection with said light socket.

30. An integral LED light fixture according to claim 27 wherein said set of LEDs are a set of AC LED diodes and said electrical circuit effects the transmission of AC current to said set of AC LED diodes.

31. An integral LED light fixture according to claim 21 wherein lens-connection protrusions extend inwardly from said forwardly extending outer wall towards said non-electrically conducting, forwardly extending outer wall, and said lens includes lens-connection protrusion connectors for cooperating with said lens-connection protrusions to removably lock said lens and said housing base together.

* * * * *